US007385616B2

(12) United States Patent
Tseng et al.

(10) Patent No.: US 7,385,616 B2
(45) Date of Patent: Jun. 10, 2008

(54) METHOD FOR AUTOMATICALLY ADJUSTING PICTURE FRAMES ON A DISPLAY DEVICE

(75) Inventors: Shih-Hua Tseng, Taipei (TW); Ray-Din Lee, Lujhou (TW); Kuen-Long Lee, Sijhih (TW)

(73) Assignee: Tatung Co., Ltd., Taipei (TW)

( * ) Notice: Subject to any disclaimer, the term of this patent is extended or adjusted under 35 U.S.C. 154(b) by 720 days.

(21) Appl. No.: 10/990,470

(22) Filed: Nov. 18, 2004

(65) Prior Publication Data

US 2005/0140698 A1 Jun. 30, 2005

(30) Foreign Application Priority Data

Dec. 29, 2003 (TW) ..... 92137337 A

(51) Int. Cl.
*G09G 5/00* (2006.01)

(52) U.S. Cl. ..... 345/660; 345/213

(58) Field of Classification Search ..... 345/660–671, 345/3.1–3.4, 213; 348/554–558
See application file for complete search history.

(56) References Cited

U.S. PATENT DOCUMENTS 6,757,026 B2 * 6/2004 Joo ..... 348/581
7,133,053 B2 * 11/2006 Chen ..... 345/660
2003/0184566 A1 * 10/2003 Cheng ..... 345/660

* cited by examiner

*Primary Examiner*—Amr Awad
*Assistant Examiner*—Daniel Tsegaye
(74) *Attorney, Agent, or Firm*—Bacon & Thomas, PLLC

(57) ABSTRACT

A method for automatically adjusting pictures on a display device, by which a plurality of reference points and the corresponding slope values are stored in a memory of the display device. The reference points and the corresponding slope values, as well as the synchronous frequency and the image timing, set by a user are used by a microprocessor within the display to determine whether to adjust the picture frame and the display position of the pictures, so as to fit the preset display values by the user.

5 Claims, 11 Drawing Sheets

METHOD FOR AUTOMATICALLY ADJUSTING PICTURE FRAMES ON A DISPLAY DEVICE

BACKGROUND OF THE INVENTION

1. Field of the Invention

The present invention relates to a method for automatically adjusting picture frames on a display device.

2. Description of Related Art

As shown in FIG. 1, a computer device 10 comprises a central processing unit 12 (CPU), a display driver 14, a memory 16 and a first communication controller 18. A display device 20 comprises a deflection circuit 22, an imaging circuit 24, a microprocessor 26, a memory 28, a screen 30 and a second communication controller 32. The screen 30 is for displaying picture frames, and the first communication controller 18 and the second communication controller 32 are for exchanging data between the computer device 10 and the display device 20. The display driver 14 outputs synchronous signals to the deflection circuit 22 for determining the horizontal synchronous frequency, the horizontal image timing, the vertical synchronous frequency and the vertical image timing of the displayed picture frame. The display driver 14 also outputs image signals to the imaging circuit 24 for setting the colors of the picture frames to be displayed. The microprocessor 26 can receive the adjusting signals from an on-screen display (OSD) means and change the output signals from the deflection circuit 22 and the imaging circuit 24, so as to adjust the picture frame and the display position of the picture frame to be displayed.

As shown in FIG. 2, the horizontal imaging time corresponding to the displayed picture frame, denoted by C, is set to be covered within the horizontal synchronous time so as to assure normal display of a picture frame. The blanking time is defined to be the sum of the synchronous pulse time (denoted by A), the front entrance time (denoted by B) and the rear entrance time (denoted by D); the blanking time is the flyback time needed for initiating a picture frame. The sum of the synchronous pulse time, the front entrance time, the rear entrance time and the horizontal imaging time defines the horizontal synchronous time, in which the horizontal imaging time is the time required to display a row of picture frames. On the other hand, the vertical imaging time is the time required to display a whole picture frame.

When a user adjusts a picture frame of the display device 20 by OSD means, it is possible that the horizontal imaging time is shifted so that it leads or lags the horizontal synchronous time, and therefore the picture frame cannot be normally displayed. A similar problem may occur in the vertical image timing. So far there is no preferable method to prevent the above-cited problem. There is however a method to adjust the size and position of a picture frame for display entitled "Display" and disclosed by U.S. Pat. No. 5,021,719. The method is disadvantageous in that the sampling of the synchronous time by a microprocessor causes up and down, right and left shifting of a picture frame before the display is optimized, which is time consuming and not appealing to users.

Therefore, it is desirable to provide an improved method for automatically adjusting picture frames on a display device to mitigate and/or obviate the aforementioned problems.

SUMMARY OF THE INVENTION

The primary objective of the present invention is to provide a method for automatically adjusting picture frames on a display device, by which a picture frame can be quickly adjusted to a suitable picture frame and a suitable display position.

Another objective of the present invention is to provide a method for automatically adjusting picture frames on a display device, which can judge if a user's settings are adequate and thereby determine whether a display adjustment should proceed.

To achieve the above objectives, a method for automatically adjusting a picture frame on a display device is disclosed by the present invention, by which a display size and a display position of the picture frame are automatically adjusted according to a plurality of reference points and a plurality of associated slope values stored in a memory of the display device, comprising the steps of: (A) determining whether the automatic adjustment of the picture frame is required, executing step (B) if the result is positive and executing step (I) if the result is negative; (B) measuring a horizontal synchronous frequency, a horizontal image timing, a vertical synchronous frequency and a vertical image timing of the picture frame; (C) reading the reference points and the associated slope values; (D) determining whether the synchronous frequency and the image timing are correct, executing step (E) if the result is positive and executing step (I) if the result is negative; (E) adjusting a horizontal scale of the picture frame according to the horizontal synchronous frequency, the horizontal image timing, the reference points and the associated slope values; (F) adjusting a horizontal position of the picture frame according to the horizontal synchronous frequency, the horizontal image timing, the reference points and the associated slope values; (G) adjusting a vertical scale of the picture frame according to the vertical synchronous frequency, the vertical image timing, the reference points and the associated slope values; (H) adjusting a vertical position of the picture frame according to the vertical synchronous frequency, the vertical image timing, the reference points and the associated slope values; and (I) completing the automatic adjustment of the picture frame.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
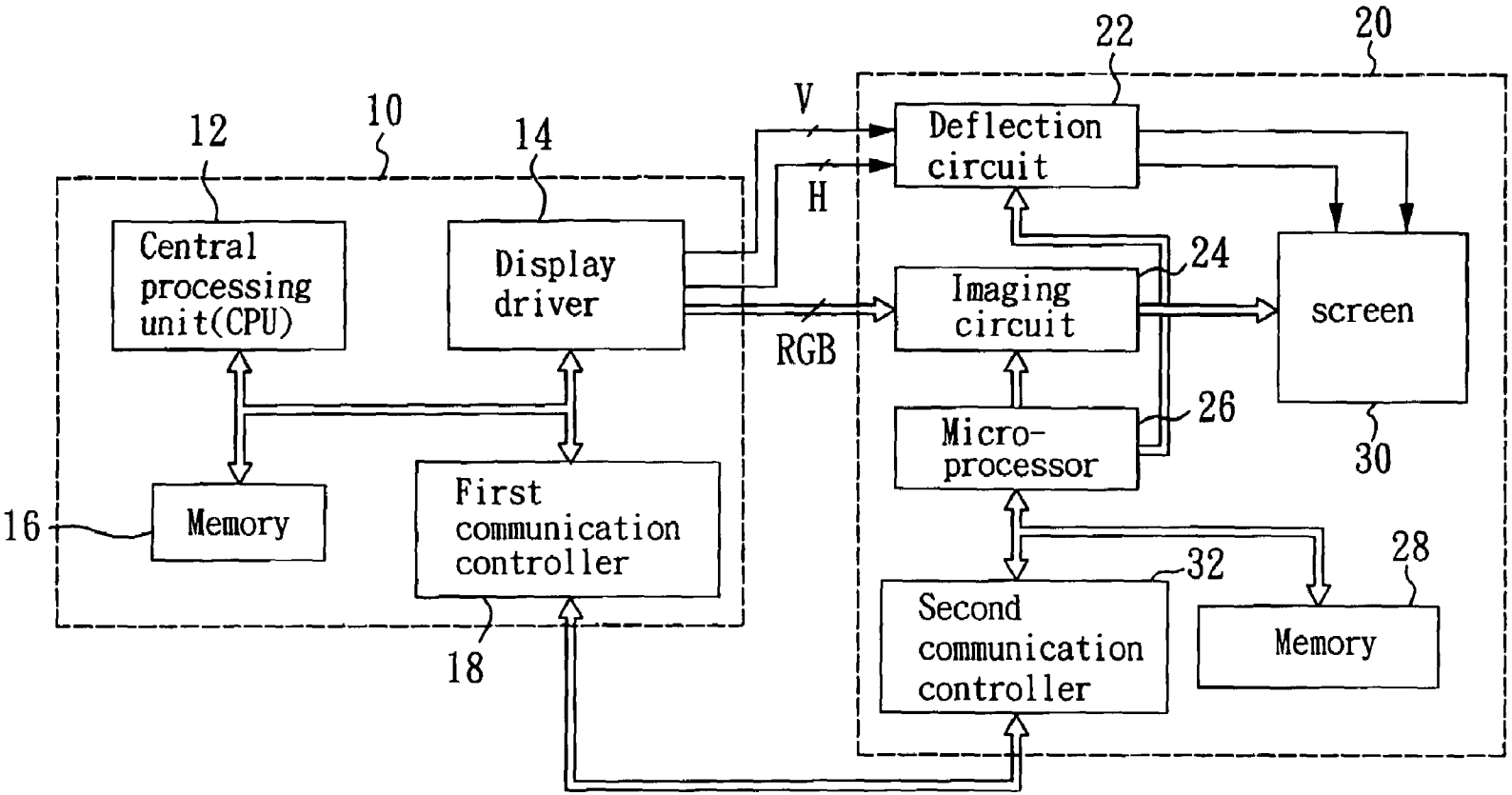
Fig. 1 (Prior Art)
FIG. 1 is a diagram showing the connection between a computer device and a display device.
Figure 2:
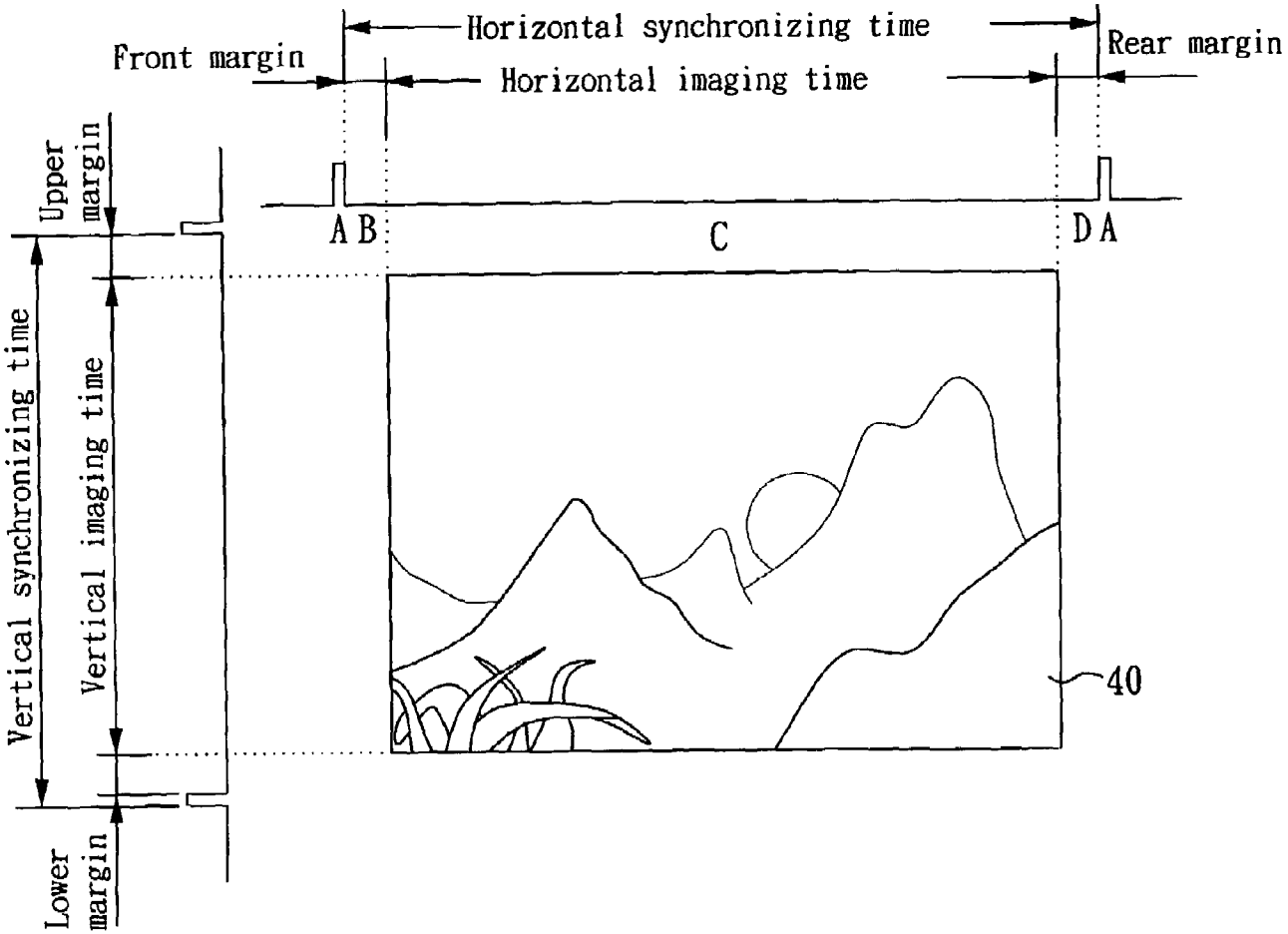
Fig. 2 (Prior Art)
FIG. 2 is a diagram showing various parameters related to a displayed picture frame.

The method for automatically adjusting picture frames on a display device 20 in accordance with the present invention utilizes a computer device 10 to optimize the display of picture frames on a display during manufacturing of the display device 20. The computer device 10 sets an optimum picture frame or an optimum display position, either of which is defined as a reference point. As the synchronous timing of a picture frame varies, a slope value representing the relationship between the change in synchronous frequency and the change in picture frame or position can be obtained by measuring the change in picture frame or position of the picture frame. The reference points and the associated slope values are obtained by engineers during the production or manual adjustment in a maintenance process, and then stored in a memory 28 of the display device 20. Therefore, since the reference points and the associated slope values are registered, the microprocessor 26 needs to sample respectively the horizontal synchronous frequency and the vertical synchronous frequency, so that the optimal picture frame and position can be quickly computed and adjusted to fit the size of the screen 30, this being obviously better than the automatic adjusting methods of the prior art.

Figure 3:
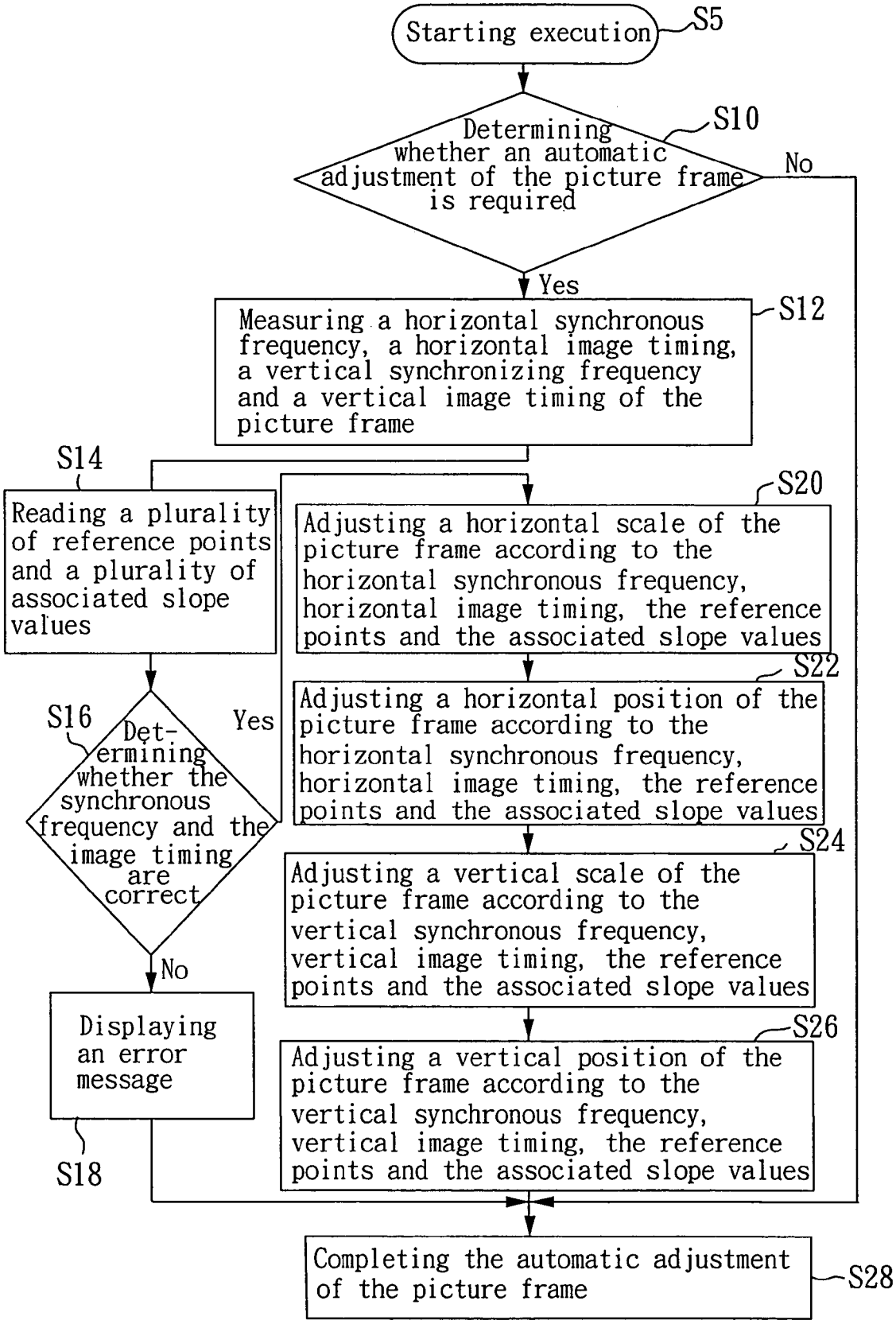
FIG. 3 is a flow chart according to the present invention for adjusting picture frames on a display device.

As shown in FIG. 3, the method for automatically adjusting the picture frame on the display device 20 comprises the following steps.

Step S5. The execution starts.

Step S10. Determining whether the automatic adjustment of the picture frame is required or not, if the result is positive, Step S12 will be executed, otherwise Step S28 will be executed. The display device 20 provides a user with two kinds of adjustment mode which correspond to automatic or manual executions respectively. If the user selects the manual adjustment mode, the procedure jumps to Step S28 corresponding to complete the automatic adjustment of the picture frame, and the user can execute the manual adjustment later. Since manual adjustment is not the subject of the present invention, none of the procedures is described in detail. If the user selects the automatic adjustment, Step S12 is the next to be executed.

Step S12. Measuring a horizontal synchronous frequency, a horizontal image timing, a vertical synchronous frequency and a vertical image timing of the picture frame. Step S14 is executed by the microprocessor 26.

Step S14. Reading the reference points and the associated slope values stored in the memory 28. Because different horizontal synchronous frequencies or different vertical synchronous frequency correspond to different frequency segments, and capacitor value effects electronic characteristic and responsive speed, so the frequency segments are called capacitor segments (CS) according to this relationship. Therefore, the horizontal synchronous frequency range provided by the display device 20 is divided into a plurality of frequency segments. The reference point is assigned as a starting point of a predetermined frequency segment, and an associated slope value is the slope of a predetermined frequency segment. Since the reference point and the associated slope value are known for a predetermined frequency segment, all the microprocessor 26 of the display device 20 needs to measure are the end point of a predetermined frequency segment, the current horizontal synchronous frequency and image timing, so as to adjust preferable horizontal picture frame and position. Since the techniques for adjusting the preferable vertical picture frame and position are similar, no further description is necessary.

Step S16. Determining whether the synchronous frequency and the image timing are correct, if the result is positive, Step S20 is executed; if the result is negative, Step S18 is executed.

Step S18. Displaying an error message, and Step S28 is then executed. When the size of the picture frame is much smaller than standard one, the display device 20 may be switched to a text mode. To avoid causing a user's confusion by the distortion of the picture frame of the text mode, the automatic adjusting function is voided after the error message is displayed.

Step S20. Adjusting the horizontal scale according to the horizontal synchronous frequency, horizontal image timing, the reference points and the associated slope values. The details of Step S20 will be described later in accompaniment with FIGS. 4 and 5.

Step S22. Adjusting the horizontal position according to the horizontal synchronous frequency, horizontal image timing, the reference points and the associated slope values. The details of Step S22 will be described later in accompaniment with FIGS. 6 and 7.

Step S24. Adjusting the vertical scale according to the vertical synchronous frequency, vertical image timing, the reference points and the associated slope values. The details of Step S24 will be described later in accompaniment with FIGS. 8 and 9.

Step S26. Adjusting the vertical position according to the vertical synchronous frequency, vertical image timing, the reference points and the associated slope values. The details of Step S26 will be described later in accompaniment with FIGS. 10 and 11.

Step S28. Completing the automatic adjustment of the picture frame, and thereby the picture frame and position will satisfy predetermined preset values and the goal of the present invention will be achieved.

Figure 4:
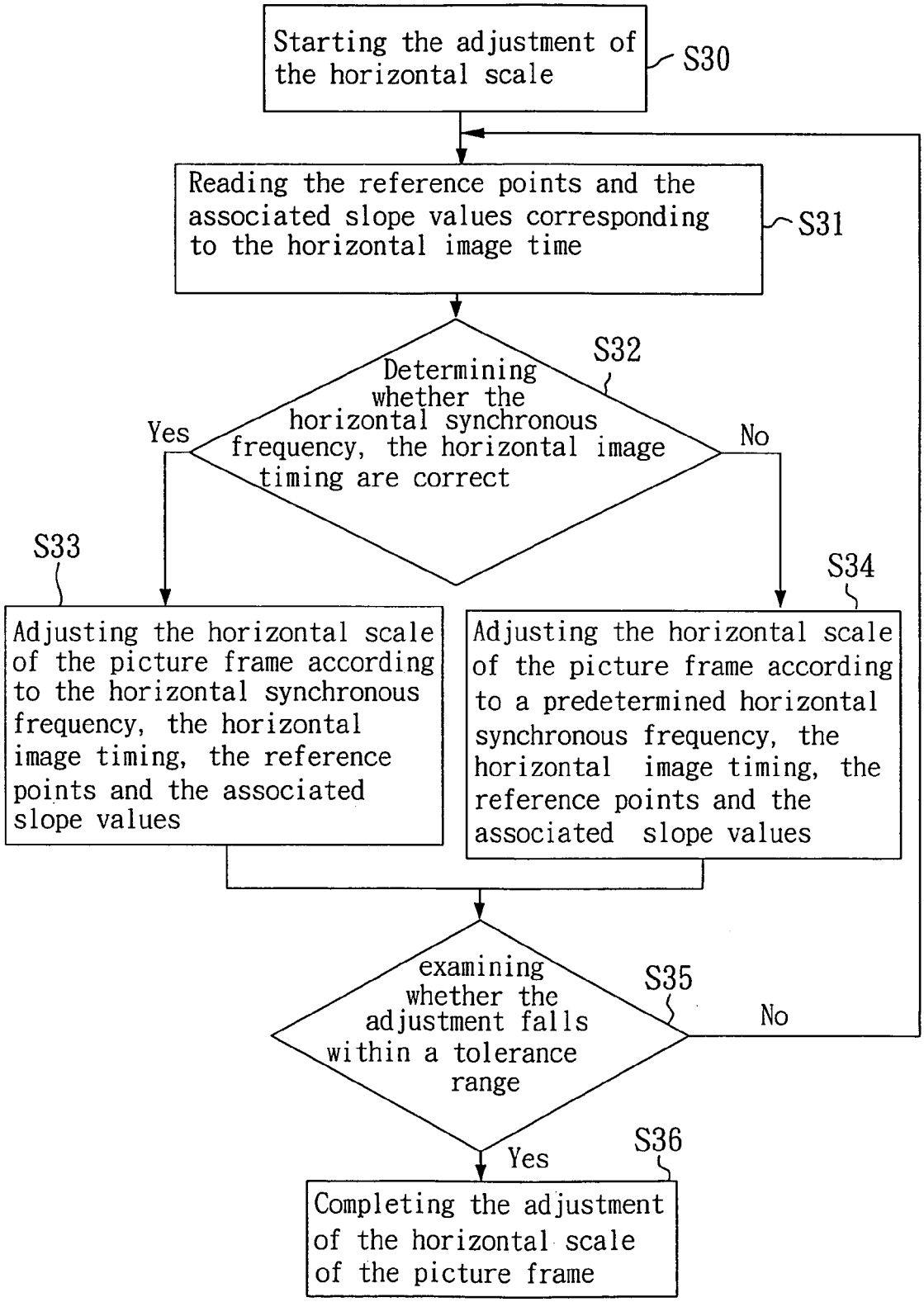
FIG. 4 is a flow chart for adjusting the horizontal scale of a picture frame on a display device.

As shown in FIG. 4, Step S20 for adjusting the horizontal scale according to the horizontal synchronous frequency, horizontal image timing, the reference points and the associated slope values further comprises the following steps.

Step S30. Starting the adjustment of the horizontal scale.

Step S31. Reading the reference points and the associated slope values of the frequency segments corresponding to the horizontal image timing.

Figure 5:
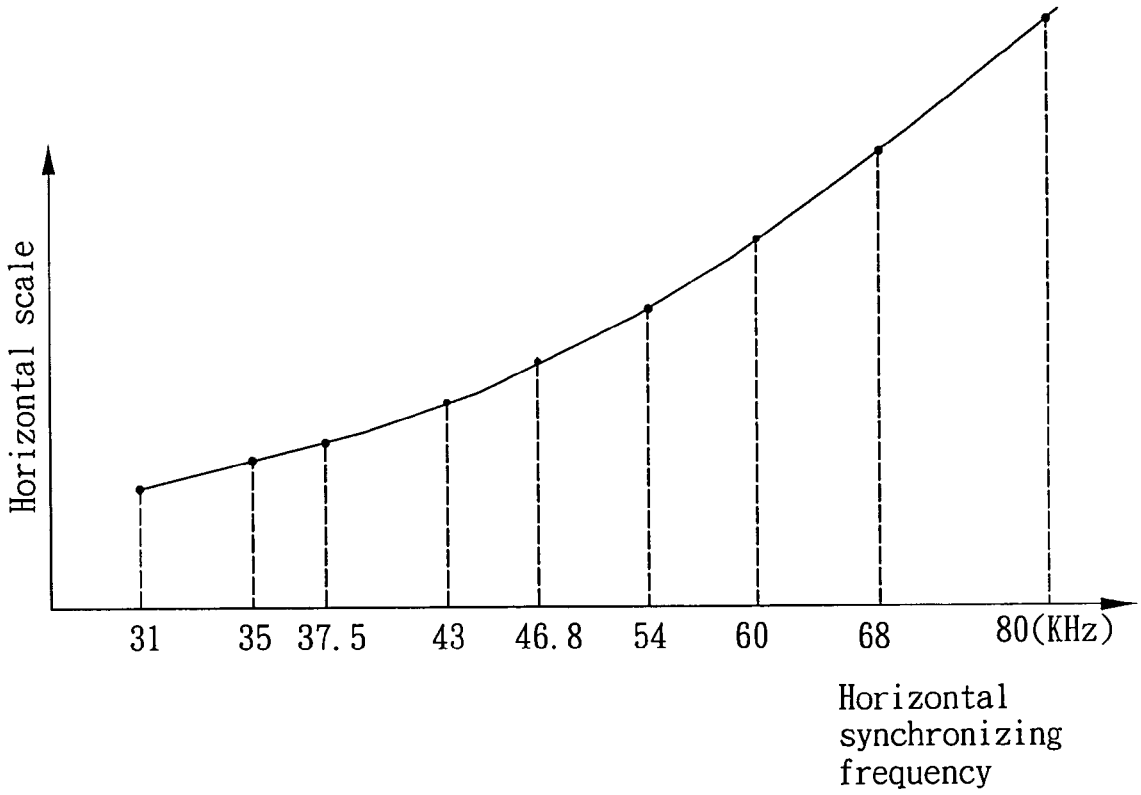
FIG. 5 shows the relationship between the horizontal image timing and the horizontal scale of a picture frame on a display device.

Step S32. Determining whether the horizontal synchronous frequency and the horizontal image timing are correct, if the result is positive, Step S33 will be executed; if the result is negative, Step S34 will be executed. Referring to FIG. 5, each of the frequency segments has a maximum, 37.5 KHz for example, and a reference point, 35 KHz for example. When the horizontal synchronous frequency of a picture frame falls within this frequency segment, the horizontal synchronous frequency is adjusted according to Step S33, otherwise, Step S34 will be the next to be executed.

Step S33. Adjusting the horizontal scale of the picture frame according to the horizontal synchronous frequency, the horizontal image timing, the reference points and the associated slope values, Step S35 is then executed. As shown in FIG. 5, since a starting point (one of reference points) and the associated slope value of each frequency segment, the horizontal image timing and the current horizontal synchronous frequency, 37 Khz for example, are known, the microprocessor 26 can calculate the preferable horizontal scale of the picture frame, 350 mm for example, at the horizontal synchronous frequency.

Step 34. Adjusting the horizontal scale of the picture frame according to a predetermined horizontal synchronous frequency, the horizontal image timing, the reference points and the associated slope values, Step S35 is then executed. Since the horizontal synchronous frequency set by the user falls out of the frequency segments, the predetermined horizontal synchronous frequency is used to determine the horizontal scale of the picture frame. The predetermined horizontal synchronous frequency is chosen from the middle point of one of the frequency segments, 36.25 KHz for example.

Step S35. Examining whether the adjustment falls within a tolerance range, if the result is positive, Step S36 is executed; if the result is negative, Step 31 is executed. After Step 33 or Step 34 is executed, the displayed horizontal scale is examined. If the horizontal scale exceeds the tolerance range, the horizontal scale of the picture frame should be readjusted; if not, the After Once horizontal scale of the picture frame is acceptable, Step S36 is then executed.

Step S36. Completing the adjustment of the horizontal scale of the picture frame.

Figure 6:
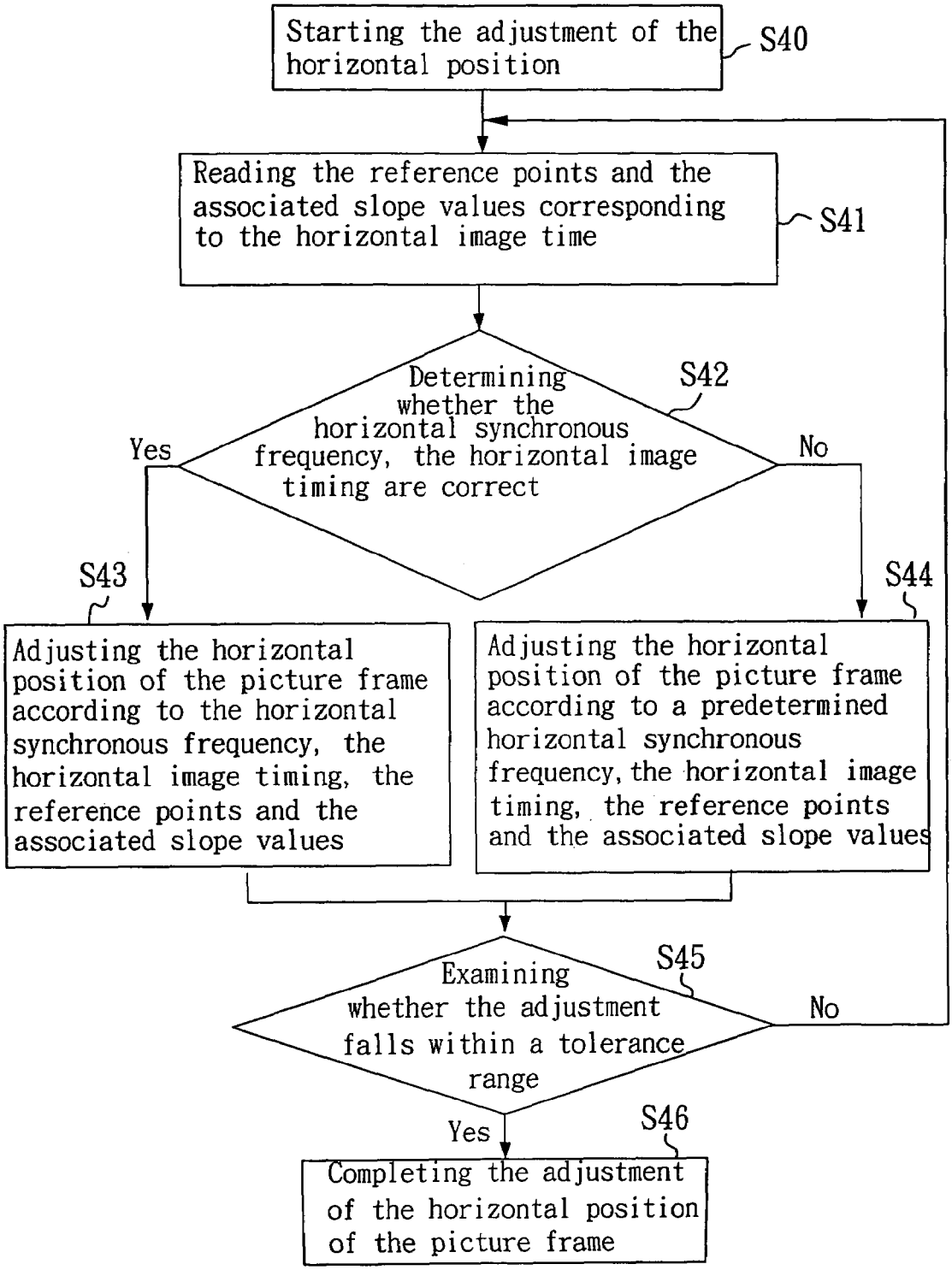
FIG. 6 is a flow chart for adjusting the horizontal position of a picture frame on a display device.
Figure 7:
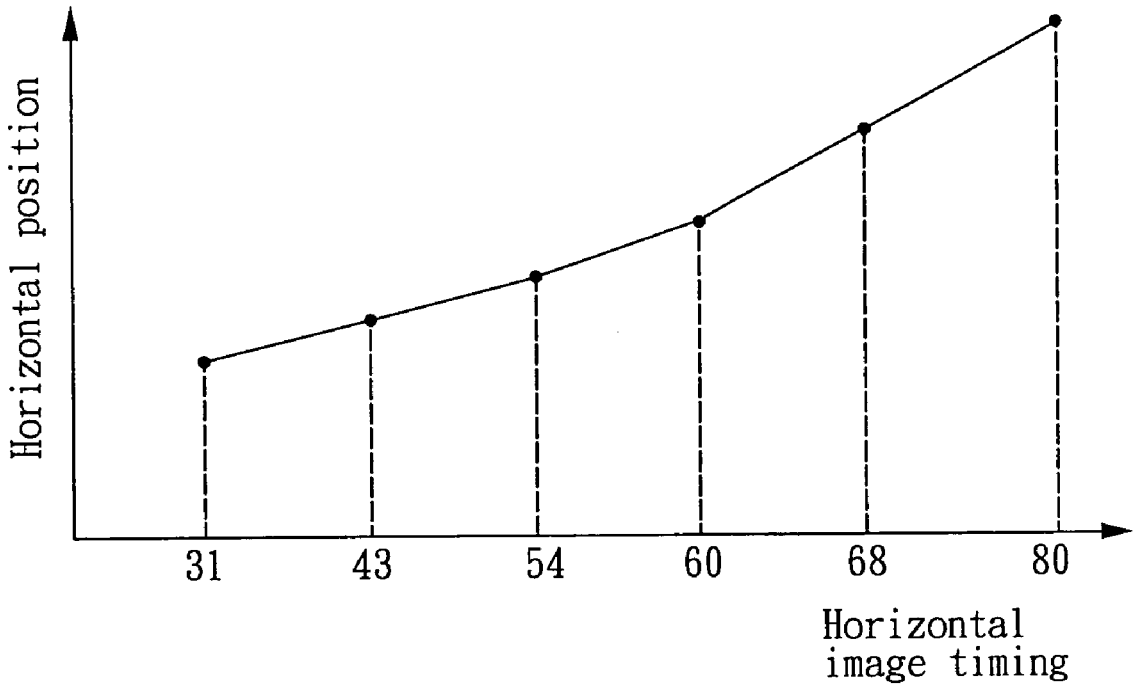
FIG. 7 shows the relationship between the horizontal image timing and the horizontal position of a picture frame on a display device.
Figure 8:
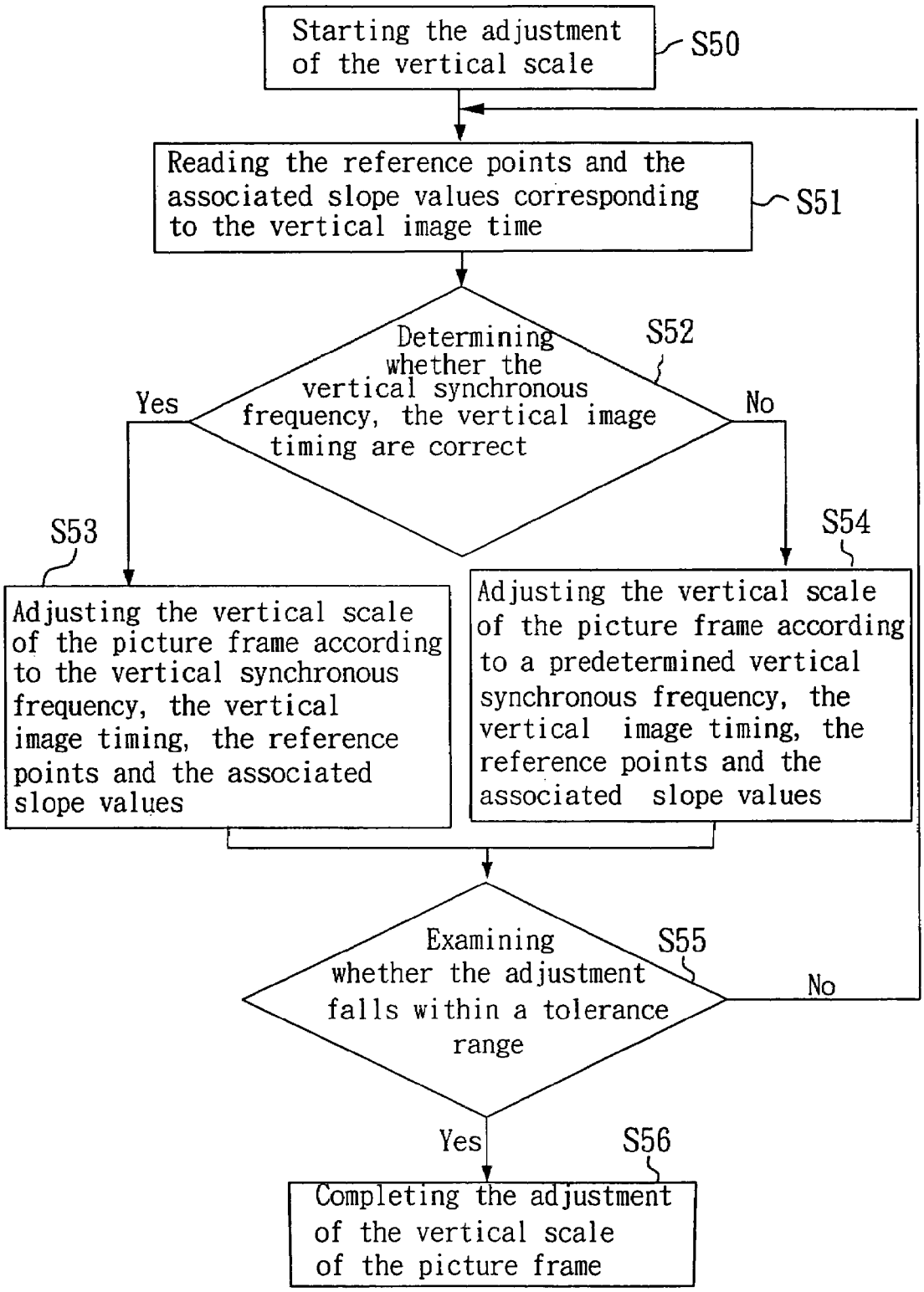
FIG. 8 is a flow chart for adjusting the vertical scale of a picture frame on a display device.
Figure 9:
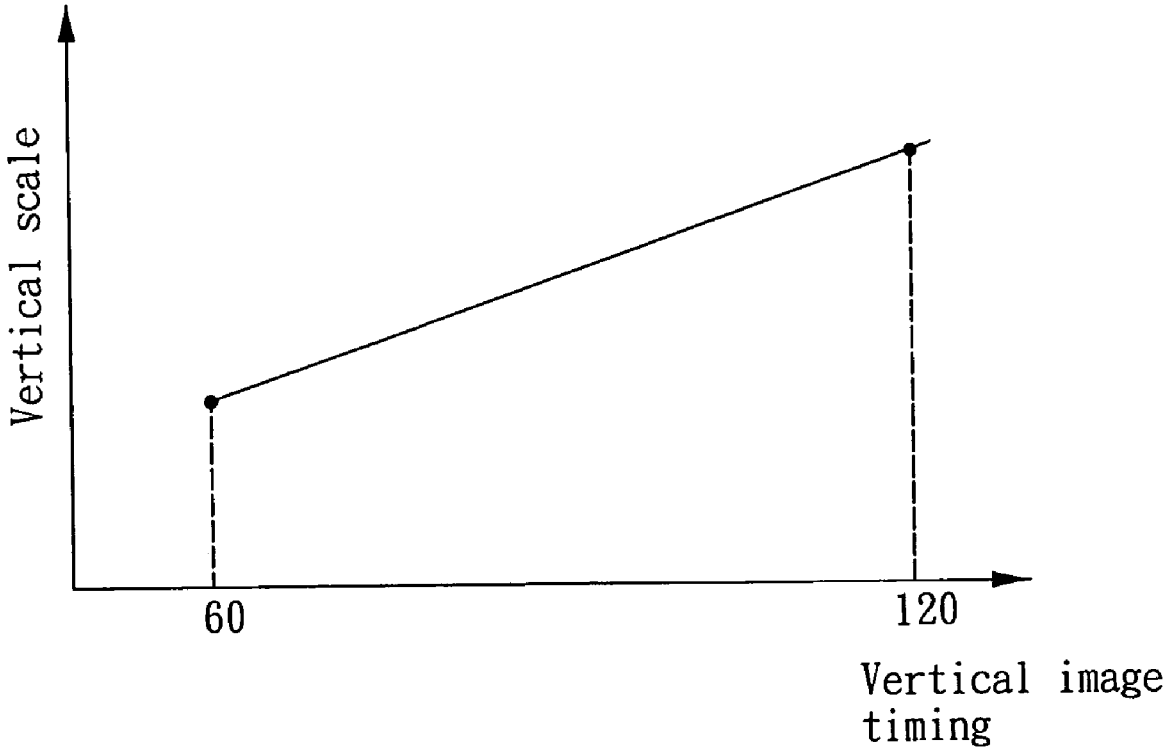
FIG. 9 shows the relationship between the vertical image timing and the vertical scale of a picture frame on a display device.
Figure 10:
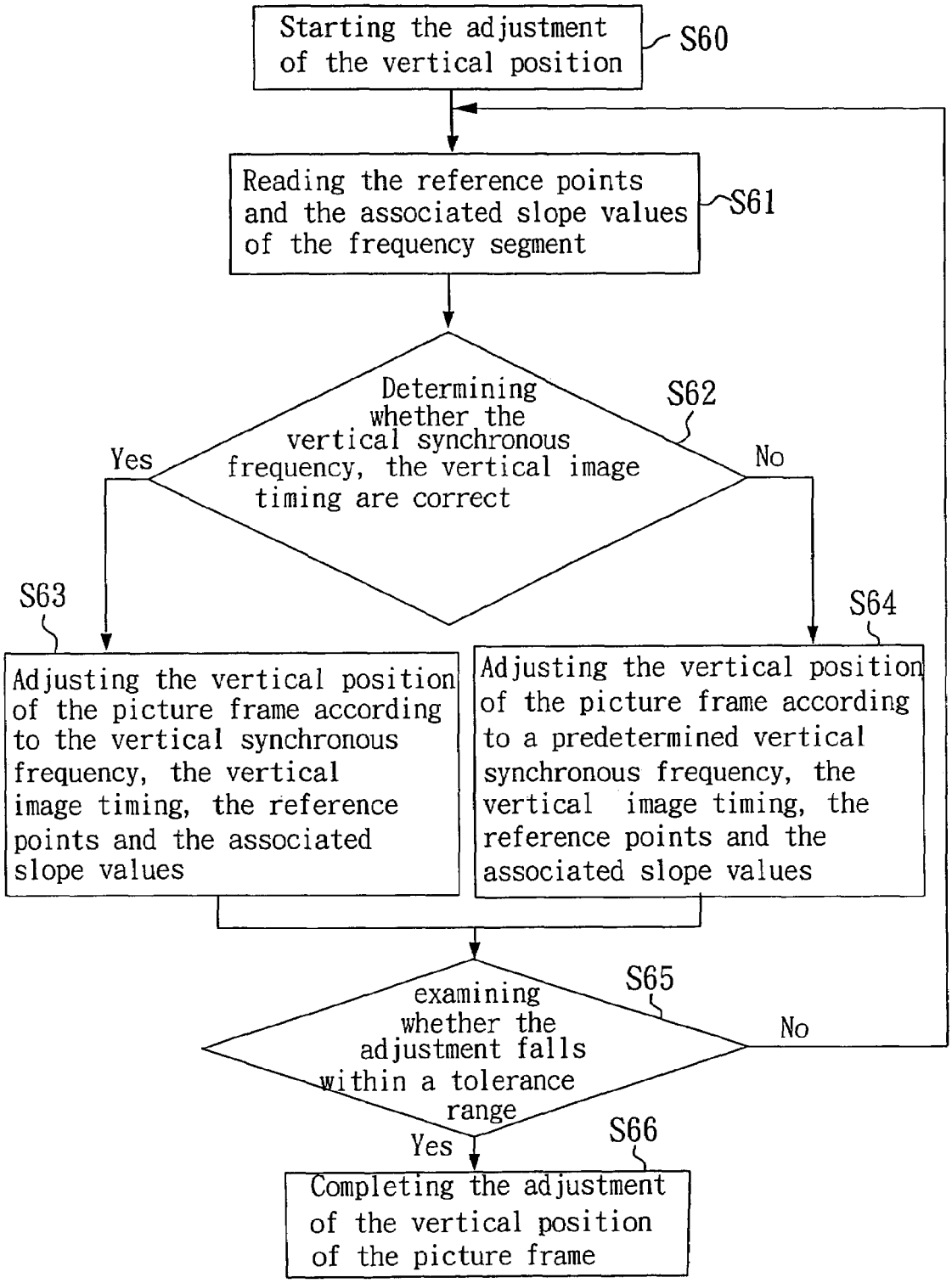
FIG. 10 is a flow chart for adjusting the vertical position of a picture frame on a display device.
Figure 11:
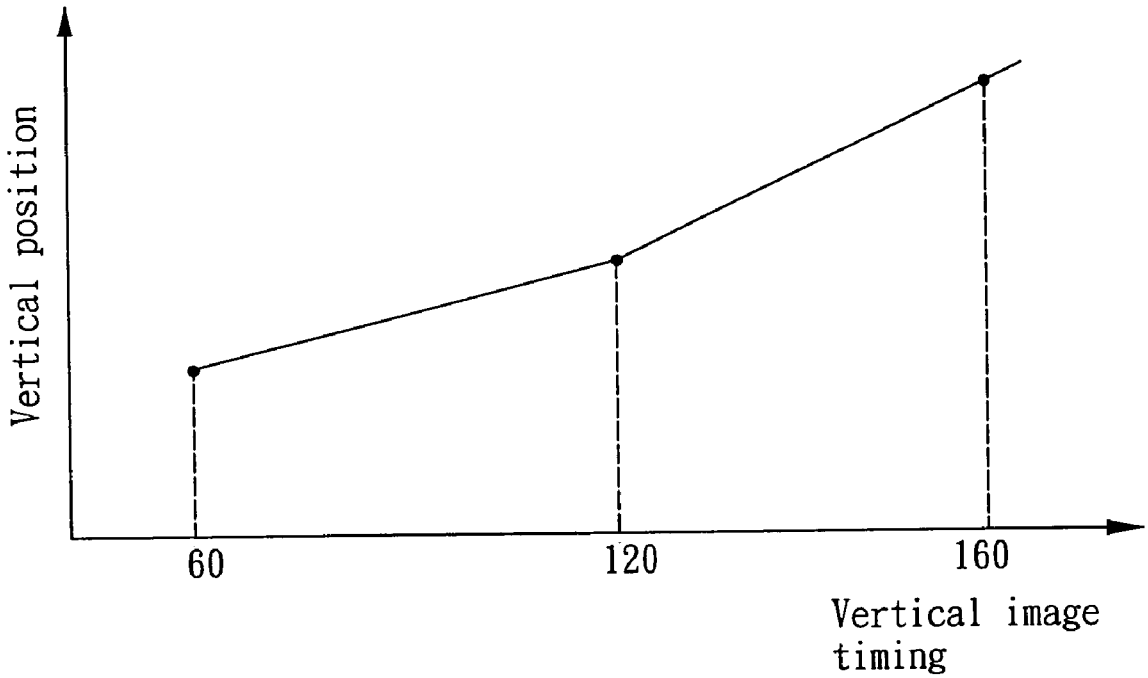
FIG. 11 shows the relationship between the vertical image timing and the vertical position of a picture frame on a display device.

FIG. 6 illustrates the procedure for adjusting the horizontal position of the picture frame for display device 20. FIG. 7 shows the relationship between the horizontal image timing and the horizontal position. FIGS. 8 and 9 respectively illustrate the procedure for adjusting the vertical scale of the picture frame for display device 20 and the relationship between the vertical image timing and the vertical scale. FIGS. 10 and 11 respectively illustrate the procedure for adjusting the vertical position of the picture frame for display and the relationship between the vertical image timing and the vertical position. Since the above-cited procedures are similar to the procedure illustrated by FIGS. 4 and 5, it is not necessary to describe them in detail.

Although the present invention has been explained in relation to its preferred embodiments, it is to be understood that many other possible modifications and variations can be made without departing from the spirit and scope of the invention as hereinafter claimed.

What is claimed is:

1. A method for automatically adjusting a picture frame on a display device, by which a display size and a display position of the picture frame are automatically adjusted according to a plurality of reference points and a plurality of associated slope values stored in a memory of the display device, comprising the steps of:

(A) determining whether the automatic adjustment of the picture frame is required, executing step (B) if the result is positive and executing step (I) if the result is negative;

(B) measuring a horizontal synchronous frequency, a horizontal image timing, a vertical synchronous frequency and a vertical image timing of the picture frame;

(C) reading the reference points and the associated slope values;

(D) determining whether the synchronous frequency and the image timing are correct, executing step (E) if the result is positive and executing step (I) if the result is negative;

(E) adjusting a horizontal scale of the picture frame according to the horizontal synchronous frequency, the horizontal image timing, the reference points and the associated slope values;

(F) adjusting a horizontal position of the picture frame according to the horizontal synchronous frequency, the horizontal image timing, the reference points and the associated slope values;

(G) adjusting a vertical scale of the picture frame according to the vertical synchronous frequency, the vertical image timing, the reference points and the associated slope values;

(H) adjusting a vertical position of the picture frame according to the vertical synchronous frequency, the vertical image timing, the reference points and the associated slope values; and (I) completing the automatic adjustment of the picture frame.

2. The method for automatically adjusting the picture frame on the display device of claim 1, wherein the step (E) further comprising the steps of:

(E1) reading the reference points and the associated slope values corresponding to the horizontal image timing;

(E2) determining whether the horizontal synchronous frequency and the horizontal image timing are correct, executing step (E3) if the result is positive and executing step (E4) if the result is negative;

(E3) adjusting the horizontal scale of the picture frame according to the horizontal synchronous frequency, the horizontal image timing, the reference points and the associated slope values, executing step (E5);

(E4) adjusting the horizontal scale of the picture frame according to a predetermined horizontal synchronous frequency, the horizontal image timing, the reference points and the slope values;

(E5) examining whether the adjustment falls within a tolerance range, executing step (E6) if the result is positive and executing step (E1) if the result is negative; and (E6) completing the adjustment of the horizontal scale of the picture frame.

3. The method for automatically adjusting the picture frame on the display device of claim 1, wherein step (F) further comprising the steps of:

(F1) reading the reference points and the associated slope values corresponding to the horizontal image timing;

(F2) determining whether the horizontal synchronous frequency and the horizontal image timing are correct, executing step (F3) if the result is positive and executing step (F4) if the result is negative;

(F3) adjusting the horizontal position of the picture frame according to the horizontal synchronous frequency, the horizontal image timing, the reference points and the associated slope values, executing step (F5);

(F4) adjusting the horizontal position of the picture frame according to a predetermined horizontal synchronous frequency, the horizontal image timing, the reference points and the slope values;

(F5) examining whether the adjustment falls within a tolerance range, executing step (F6) if the result is positive and executing step (F1) if the result is negative; and (F6) completing the adjustment of the horizontal position of the picture frame.

4. The method for automatically adjusting the picture frame on the display device of claim 1, wherein step (G) further comprising the steps of:

(G1) reading the reference points and the associated slope values corresponding to the vertical image timing;

(G2) determining whether the vertical synchronous frequency and the vertical image timing are correct, executing step (G3) if the result is positive and executing step (G4) if the result is negative;

(G3) adjusting the vertical scale of the picture frame according to the vertical synchronous frequency, the vertical image timing, the reference points and the associated slope values, executing step (G5);

(G4) adjusting the vertical scale of the picture frame according to a predetermined vertical synchronous frequency, the vertical image timing, the reference points and the associated slope values;

(G5) examining whether the adjustment falls within a tolerance range, executing step (G6) if the result is positive and executing step (G1) if the result is negative; and (G6) completing the adjustment of the vertical scale of the picture frame.

5. The method for automatically adjusting the picture frame on the display device of claim 1, wherein step (H) further comprising the steps of:

(H1) reading the reference points and the associated slope values corresponding to the vertical image timing;

(H2) determining whether the vertical synchronous frequency and the vertical image timing are correct, executing step (H3) if the result is positive and executing step (H4) if the result is negative;

(H3) adjusting the vertical position of the picture frame according to the vertical synchronous frequency, the vertical image timing, the reference points and the associated slope values, executing step (H5);

(H4) adjusting the vertical position of the picture frame according to a predetermined vertical synchronous frequency, the vertical image timing, the reference points and the associated slope values;

(H5) examining whether the adjustment falls within a tolerance range, executing step (H6) if the result is positive and executing step (H1) if the result is negative; and (H6) completing the adjustment of the vertical position of the picture frame.

* * * * *